US009840389B2

(12) United States Patent
Lewalski et al.

(10) Patent No.: US 9,840,389 B2
(45) Date of Patent: Dec. 12, 2017

(54) SHEET STACKER

(71) Applicant: Tecnau, Inc., Billerica, MA (US)

(72) Inventors: Steven P. Lewalski, Melrose, MA (US); Bruce J. Taylor, Manchester, NH (US)

(73) Assignee: Tecnau, Inc., Billerica, MA (US)

( * ) Notice: Subject to any disclaimer, the term of this patent is extended or adjusted under 35 U.S.C. 154(b) by 0 days.

(21) Appl. No.: 15/146,392

(22) Filed: May 4, 2016

(65) Prior Publication Data

US 2017/0320694 A1 Nov. 9, 2017

(51) Int. Cl.

| | |
|---|---|
| ***B65H 29/04*** | (2006.01) |
| ***B65H 31/08*** | (2006.01) |
| ***B65H 35/04*** | (2006.01) |
| ***B65H 29/18*** | (2006.01) |
| ***B65H 29/68*** | (2006.01) |

(52) U.S. Cl.

CPC ..... *B65H 29/041* (2013.01); *B65H 29/04* (2013.01); *B65H 29/045* (2013.01); *B65H 29/048* (2013.01); *B65H 29/18* (2013.01); *B65H 29/683* (2013.01); *B65H 31/08* (2013.01); *B65H 35/04* (2013.01); *B65H 2301/44712* (2013.01)

(58) Field of Classification Search

CPC .... B65H 29/041; B65H 29/04; B65H 29/045; B65H 29/047; B65H 29/048; B65H 29/02; B65H 29/683

See application file for complete search history.

(56) References Cited

U.S. PATENT DOCUMENTS

| | | | | |
|---|---|---|---|---|
| 1,615,194 | A * | 1/1927 | Swab | B65G 17/326 198/803.1 |
| 3,266,796 | A | 8/1966 | Haney et al. | |
| 3,284,081 | A | 11/1966 | Huck | |
| 3,989,239 | A * | 11/1976 | Scriven, Jr. | B65H 29/041 198/803.9 |
| 5,179,900 | A * | 1/1993 | Schwitzky | B65H 29/041 101/240 |
| 2003/0025888 | A1 * | 2/2003 | Noh | G03B 27/00 355/18 |
| 2011/0068531 | A1 | 3/2011 | Gentle et al. | |
| 2013/0112055 | A1 | 5/2013 | Lewalski et al. | |

FOREIGN PATENT DOCUMENTS

| | | | | |
|---|---|---|---|---|
| DE | 4124810 | A1 * | 1/1993 | B65H 29/041 |

* cited by examiner

*Primary Examiner* — Luis A Gonzalez
(74) *Attorney, Agent, or Firm* — Loginov & Associates; William A. Loginov

(57) ABSTRACT

This invention provides a stacker for use in forming stacks of cut sheets received from an upstream utilization device (e.g. a printer, cutter, etc.) that allows for positive driving of sheets into a stack using a stacking unit that includes a series of grippers that are adapted to grip and release a leading edge of each sheet at the appropriate time. In this manner, each sheet is gripped as it arrives from the upstream operation and is passed downstream into the stack, being released so as to properly decelerate at the stack's backstop. The grippers are mounted on a continuous belt between a pair of opposing drive sprockets. An edge sensor located upstream of the stacking unit triggers motion of the belts. The grippers are actuated by a mechanical cam arrangement to selectively grip and release at predetermined positions as the belt is driven.

20 Claims, 13 Drawing Sheets

SHEET STACKER

FIELD OF THE INVENTION

This invention relates to web handling equipment that is employed peripherally to printing devices, and more particularly to devices that stack cut sheets at high speed.

BACKGROUND OF THE INVENTION

Modern printing operations often rely upon high-speed electronic printers that generate printed output on a throughput continuous web (e.g. a paper web) in a single or side-by-side series of printed pages that are (optionally) slit and cut into individual page sheets. The pages are (optionally) merged and directed downstream into a stacker that creates finished stacks for further downstream handling operations—such as binding, folding, inserting, embossing, punching, etc. The finished stacks can be used for a variety of purposes that are clear to those of skill. Sheets can be received in a stack at a speed that creates certain challenges to generating a properly aligned stack—for example, sheets should be decelerated appropriately to arrive at a proper position in the stack, and should be gripped sufficiently while transiting into the stack to avoid slippage that could result in a misaligned page. Sheets may also be subjected to aerodynamic or electrostatic forces that can affect proper entry into the stack.

Many contemporary stackers employ powered elastomeric wheels or belts in combination with a descending support to direct sheets into a stack. Sheets are received by the wheels/belts and driven into the stack in a desired order. As the stack grows, the support descends to make room for the growing stack height. However, high-speed delivery of sheets can tax the capabilities of such an arrangement.

Moreover, many sheets (substrates) are composed of (or include) materials that add challenges to the stacker and its operation. Many stackers have difficulty handling sensitive substrates, difficult media and applications with heavy or sensitive ink coverage. The thickness of the media can also challenge some stackers. Likewise, it is desirable that stackers be able to handle merged or stream folded substrates.

SUMMARY OF THE INVENTION

This invention overcomes disadvantages of the prior art by providing a stacker for use in forming stacks of cut sheets received from an upstream utilization device (e.g. a printer, cutter, etc.) that allows for positive driving of sheets into a stack using a stacking unit that includes a series of grippers that are adapted to grip and release a leading edge of each sheet at the appropriate time. In this manner, each sheet is gripped as it arrives from the upstream operation and is passed downstream into the stack, being released so as to properly decelerate at the stack's backstop. The grippers are mounted on a continuous belt (e.g. a timing belt) between a pair of opposing drive sprockets. One of the sprockets is driven by a motor (e.g. an encoder-connected motor) that is triggered to move a predetermined distance at a predetermined time. An edge sensor located upstream of the stacking unit triggers motion of the belts based signals from a controller. The grippers are actuated by a mechanical cam arrangement to selectively grip and release at predetermined positions as the belt is driven. The location of the stacking unit can be moved upstream or downstream on (e.g.) drive screws to accommodate sheets of various lengths based on information provided to the controller. A plurality of stacking units can be mounted sided by side across a width of the stacking area to accommodate wide sheets or multiple side-by-side stacks of sheets. The stacking area can include a descending elevator to accommodate growing stack sizes.

In an illustrative embodiment a system for stacking sheets is provided. The system includes an input drive that receives sheets from a source and directs the sheets in a downstream direction at a selected input velocity. A gripper assembly having a plurality of gripper units is provided. Each gripper unit includes a jaw member that moves between an open and a closed, gripped, position. The gripper units are mounted on a continuously moving surface that locates each of the gripper units over a stacking location, moving in the downstream direction. A controller operates the moving surface so that one of the gripper units moves to a closed position when a downstream edge of a respective one of the sheets is located at the jaw member. That gripper unit moves to an open position when the downstream edge is adjacent to a backstop in the stacking location. Illustratively, the moving surface comprises a belt located between rotating sprockets and the gripper assembly includes side plates that enclose the belt and the sprockets. The side plates can include a raceway in which a base member of each of the gripper units is guided, and the jaw member can include a cam follower that rides along a ramp when the jaw member is located over the stacking location. The gripper units can also each include a spring that normally biases the jaw member into a closed position and that is overcome by action of the cam follower in engagement with the ramp. The jaw member can include an extension finger that extends outwardly and downwardly into pressurable engagement with a top sheet at the stacking location and that defines a ramp for the sheets directed from the input drive. The extension finger can be constructed from a thin, flexible material such as spring steel. Alternatively, other flexible sheet materials such as polymer (e.g. Mylar®) can be employed to construct the extension finger. The gripper assembly can be mounted on a carriage and can be operatively connected with a drive motor located on one of the side plates or a drive shaft interconnected with a motor on the carriage. The carriage can be constructed and arranged to move upstream and downstream with respect to the stacking location based upon a length of each of the sheets. The carriage can be constructed and arranged to support at least another side-by side gripper assembly having a plurality of gripper units, each with a jaw member that moves between an open and a closed, gripped, position. The gripper assembly and the other (side-by-side) gripper assembly are each positioned to handle either wide sheets or a plurality of side-by-side streams of sheets. The stacking location can include an elevator that moves downwardly as a size of a stack of the sheets at the stacking location increases and that moves into position with a conveyor when the stack is completed. In various embodiments, an edge detector is operatively connected to the controller, which senses when each of the sheets from the input drive is a predetermined distance from the gripper assembly and thereby controls the gripper assembly. The gripper units each include another jaw member that moves between an open and a closed, gripped, position so as to define a pair side-by-side of jaw assemblies for gripping sheets. The pair of assemblies prevents racking of sheets as they are gripped and transported. At least three gripper units are provided on a continuous belt with at least one of the gripper units located on a top side of the belt.

In another illustrative embodiment, a method for stacking sheets with the system described-above is provided. The gripper assembly is accelerated so that the one of the gripper units moves from a home position to match the input velocity. An input sheet is driven at approximately the input velocity while it is gripped with the jaw member in the closed position. Subsequently, the sheet is decelerated as the one of the gripper units moves toward the backstop. The gripper unit is then halted at the backstop as the jaw member is moved to an open position to release the respective sheet on a stack at the stacking location.

BRIEF DESCRIPTION OF THE DRAWINGS

The invention description below refers to the accompanying drawings, of which.

DETAILED DESCRIPTION

Figure 1:
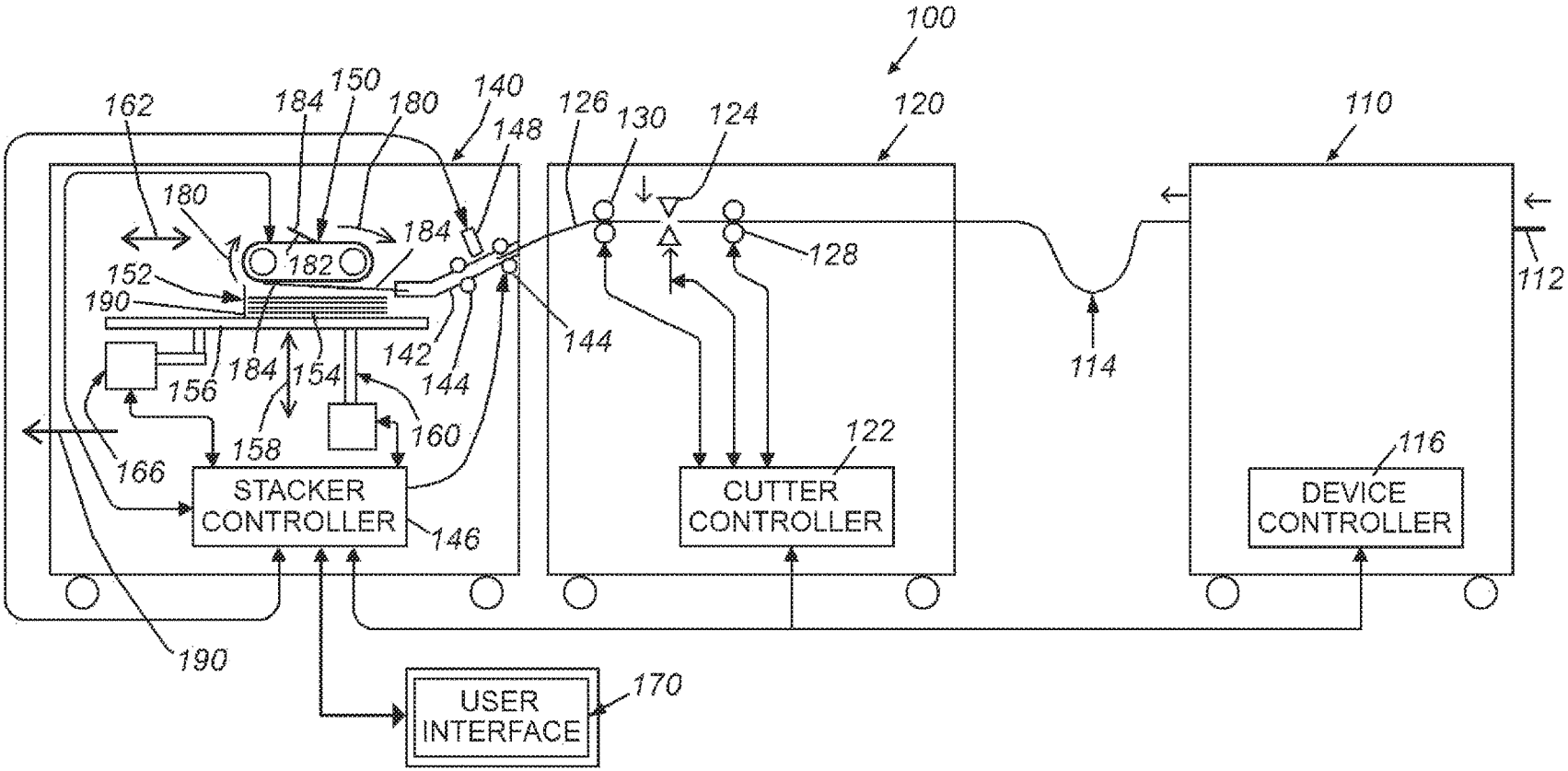
FIG. 1 is a schematic diagram showing an overview of a system for utilizing, cutting and stacking sheets, including a stacker assembly employing a gripper assembly according to an illustrative embodiment.

FIG. 1 shows a schematic view of a sheet handling system 100 according to an exemplary embodiment. The exemplary system 100 includes a utilization device 110 in which a continuous web of (e.g.) paper 112 enters from an upstream source (not shown) that can be a driven roll or the output from another utilization device. Illustratively, the utilization device can be an electronic/ink jet printer or another device that applies information or modifications to the throughput web 112. The web exits the utilization device and can be accumulated in a loop 114 or other geometry. The utilization device handles and drives the web 112 based upon a controller 116 of known or custom design. The web 114 enters a downstream cutter 120. The cutter is controlled by a controller 122 that drives the web and also activates a cutting blade arrangement 124 of any acceptable design (e.g. a guillotine-type cutter, a spiral, blade cutter, a cross cutter, etc.). The cutter 120 generates cuts in the web at desired positions so as to create individual sheets 126. The controller 122 determines where cuts should occur based upon tracking of the web motion. Such tracking can include reading of motion signals from the drive assembly 128, 130 and/or the use of edge detectors and/or tracking of printed marks on the web.

The cutter 120 can include various slitting elements so that a plurality of side-by-side sheets can be produced from a single wide web by cutting it along its width (wherein "length" herein is aligned along the upstream-to-downstream driving direction of the web and "width" is aligned transverse to the length). An example of a sheet cutting and slitting arrangement is shown and described in commonly assigned U.S. Published Patent Application No. US 2013/0112055 A1, entitled SHEET SLITTING MECHANISM WITH AUTOMATED SIZE ADJUSTMENT, by Steven P. Lewalski and Bruce J. Taylor, filed Nov. 7, 2011, the teachings of which are incorporated herein by reference as useful background information.

Output sheets 126 from the cutter 120 are driven by the drive assembly 130 down a ramp 142 of the stacker assembly 140 according to an illustrative embodiment. Each sheet is driven at a controlled speed via the stacker sheet drive assembly 144. A controller 146 operates the various functions of the stacker 140. Each sheet passes an optical (or other type of) edge detector 148 that transmits a signal to the controller 146. This signal regulates the timing of a gripper assembly 150 according to an embodiment. The gripper assembly 150 overlies a stacking area 152 that supports a sheet stack 154 having cut sheets of a desired size and shape. The stack 154 is built on a support assembly 156 that reciprocates upwardly and downwardly (double arrow 158), gradually descending based on the operation of an elevator assembly 160. The elevator assembly can be implemented as any acceptable actuation mechanism—including, but not limited to, a (worm) drive screw arrangement, a fluid piston, a linear motor and/or rack-and-pinion arrangement. The entire support assembly 156, including the gripper assembly 150 is movable in an upstream or downstream direction (double arrow 162) to accommodate sheets of differing lengths. The length can be adjusted, based upon controller signals, using an appropriate actuation assembly 166. The actuation assembly can be implemented using a variety of mechanisms—including, but not limited to, a (worm) drive screw arrangement, a fluid piston, a linear motor and/or rack-and-pinion arrangement. A user interface 170 can be employed to enter sheet length and other pertinent data to the controller 146 and/or other system components. Any acceptable user interface arrangement can be employed, including, but not limited to, a display, keyboard, mouse and/or touchscreen.

As described further below, the gripper assembly 150 is powered by a gripper drive motor that rotates (double curved arrow 180) a belt assembly 182 to cause grippers 184 to selectively engage a leading (downstream) edge of each sheet as it is driven down the ramp 142. The grippers 184 interact with a cam arrangement (described below) to selectively open and close the grippers at appropriate times. In this manner, sheets are engaged by the grippers as their respective leading edges drive under the gripper assembly 150 (and into the stack 154), and are disengaged as the sheets contact a movable backstop 190, that forms the downstream edge of the stack 154. In this embodiment, the backstop 190 underlies the gripper assembly 150. Each disengaged gripper 184 passes out of the stacking area and rotates to the top of the assembly on its way to the next input sheet.

Figure 2:
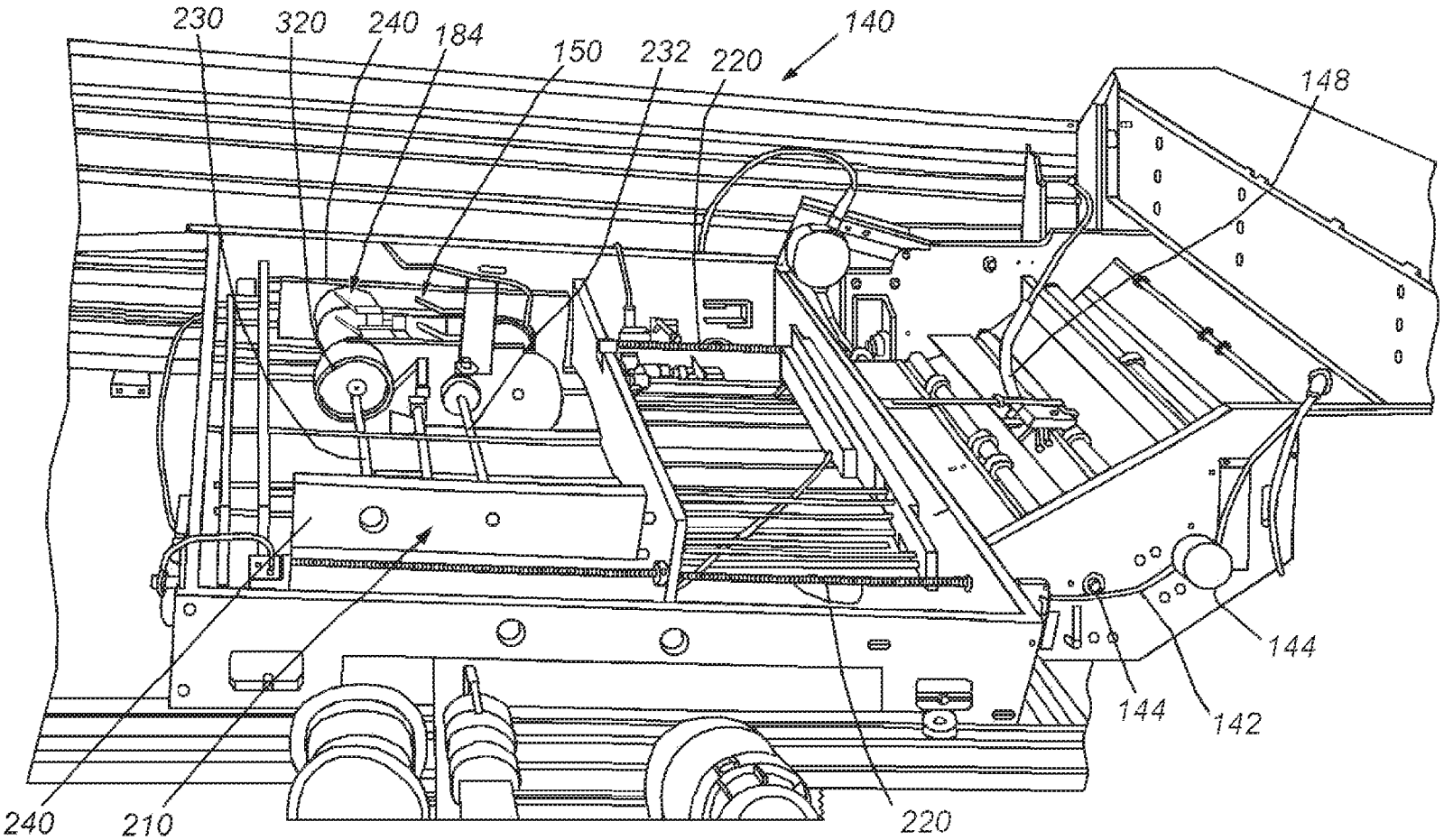
FIG. 2 is a diagram of the stacker assembly of FIG. 1.
Figure 3:
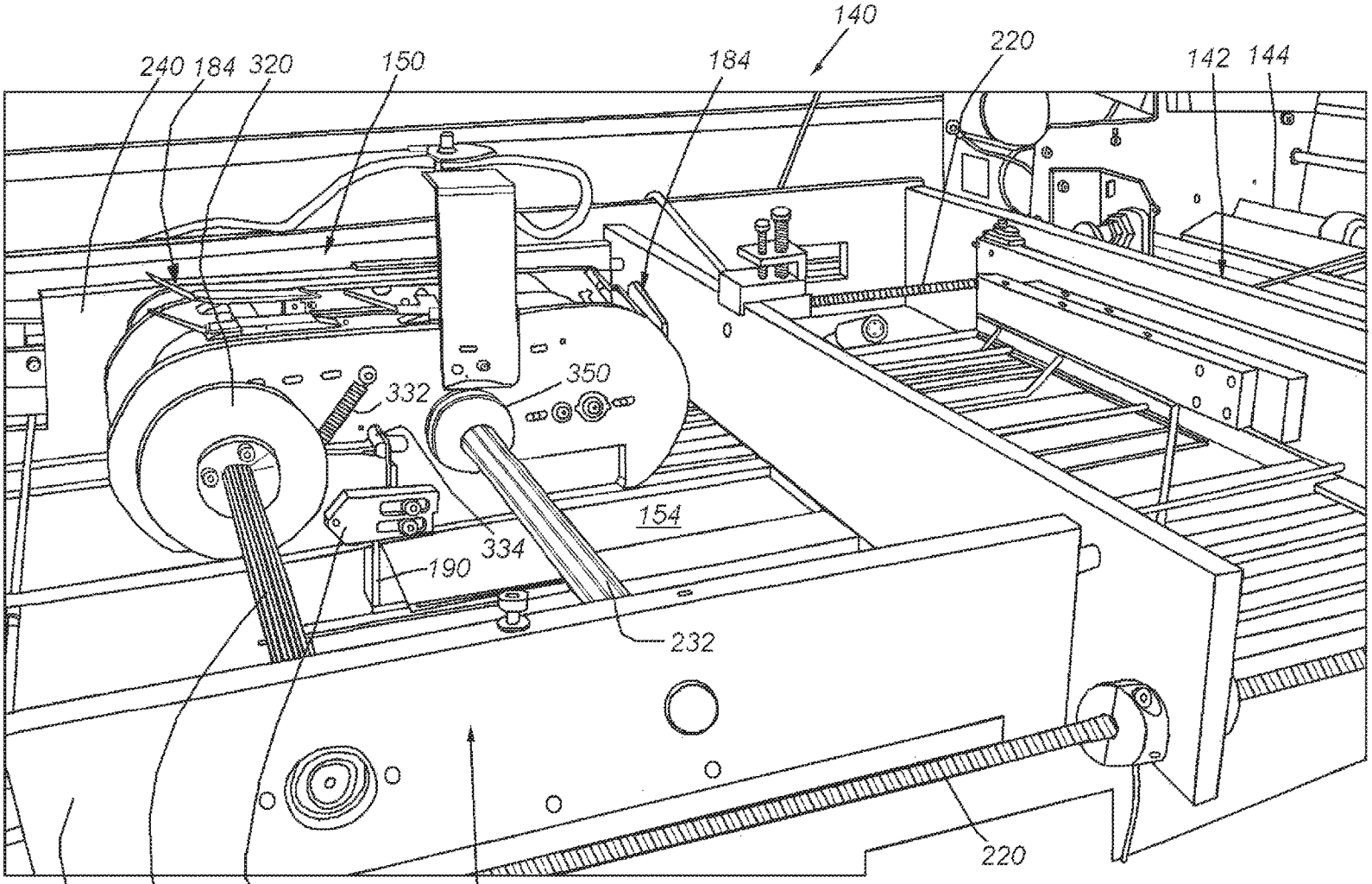
FIG. 3 is a more detailed diagram of the stacker of FIG. 2 showing the gripper assembly and associated carriage.

The stacker assembly 140 is shown in greater detail in the embodiments of FIGS. 2 and 3. The gripper assembly 150 is mounted on a moving (upstream/downstream) carriage 210 along with the backstop 190. The carriage 210 is driven by parallel, spaced-apart lead screws 220, extending upstream/downstream, that rotate in unison to adjust the upstream/downstream position of the carriage 210 based on sheet length. The controller 146 can include a circuit and/or process that computes (using an algorithm or look-up table) the appropriate adjustment for a given sheet length. A drive motor and transmission arrangement (not shown) responds to signals from the controller to rotate the screws 220. Note that the backstop 190 is movable in an upstream/downstream direction over a limited range with respect to the carriage 210, and is moved from a resting state (under bias of a spring 332) by a rotating cam 320 and cam follower 330. The backstop pivots on a pivot shaft 334 extending through the gripper assembly 150. This motion causes justification of the downstream edge of the stack 154.

The cam 320 rides on a splined shaft 230 that extends between bearings on opposite sides 240 of the carriage 210. The splined shaft 230 passes through the downstream (rear) drive sprocket of the gripper assembly 150. The gripper assembly 150 is further supported by a transverse rod 232 upstream of the shaft 230, which also extends between the opposing sides 240 of the carriage 210. Because the shaft 230 is splined, the gripper assembly 150 can adjustably slide along it between the two carriage sides 240. The gripper assembly 150 includes a collet base 350 that can include set screws (not shown), or other locking components, that secure the assembly 150 in a side-to-side location in the carriage with respect to the transverse rod 232. In operation, the gripper assembly 150 can be moved side-to-side to be optimally located for the input sheets. Additionally, a second or third gripper assembly can be mounted on the shaft 230 and rod 232 to handle wider sheets or side-by-side slit sheets.

In an illustrative embodiment, the stack support can comprise a plate or a plurality of parallel rods mounted on a framework that moves upwardly and downwardly in a reciprocating manner, descending as the stack grows. The reciprocating motion can be used to compress the stack as it grows in height. A stack height sensor is used to set the maximum height of the support each time it ascends to the compressed position. In alternate embodiments, the stack support can descend at a metered rate based on the number of sheets entering into the stack. It should be clear to those of skill that a variety of mechanisms can be used to support the stack. Completed stacks can be lowered by the support so that the rods pass between conveyor belts. The completed stack, thus, is deposited onto the conveyor belts, and is then transported by the conveyor (represented by arrow 190) to an output location for further processing (e.g. binding).

Figure 4:
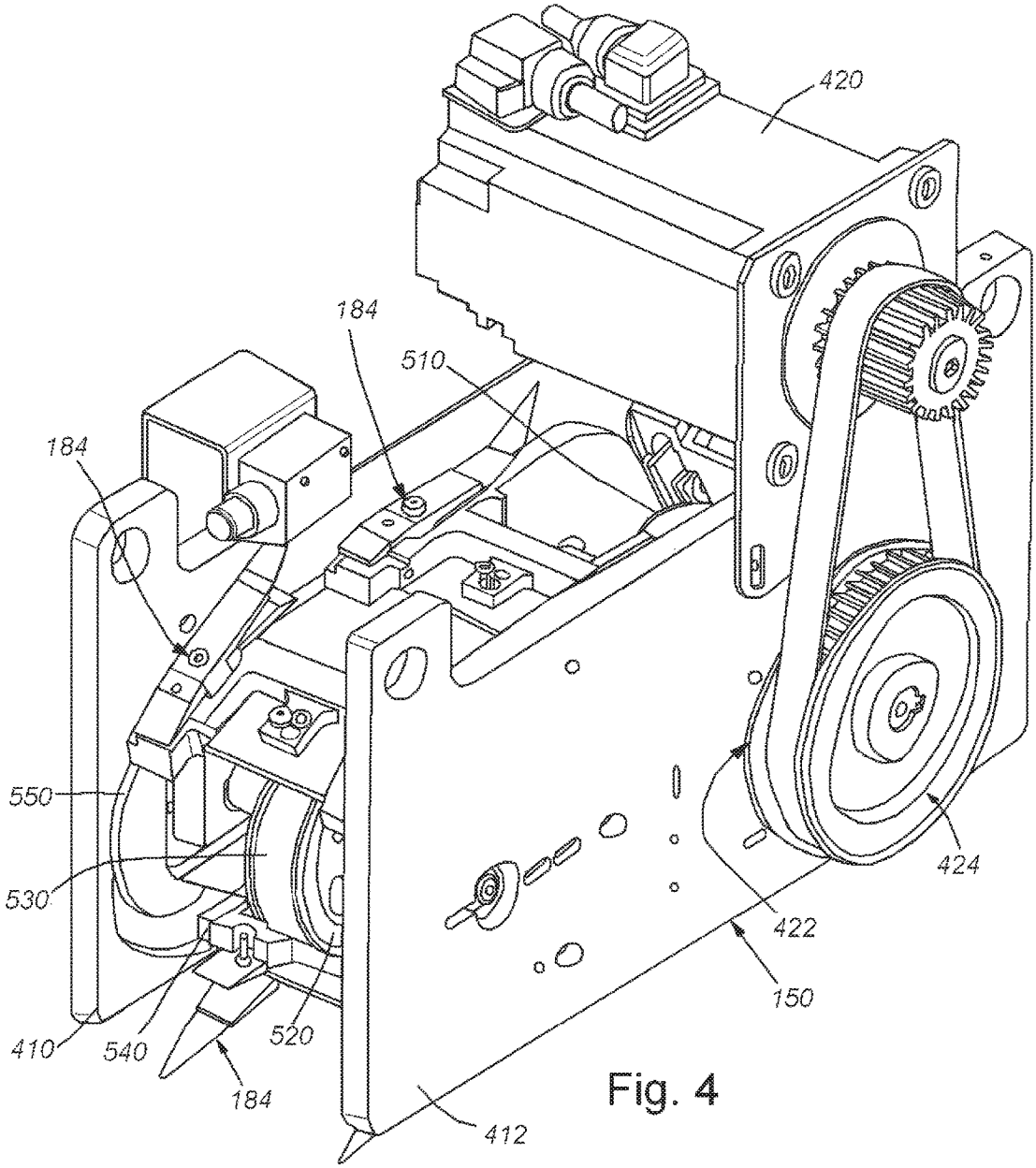
FIG. 4 is a perspective diagram of the gripper assembly of the stacker of FIG. 1 showing an on-board drive motor.
Figure 5:
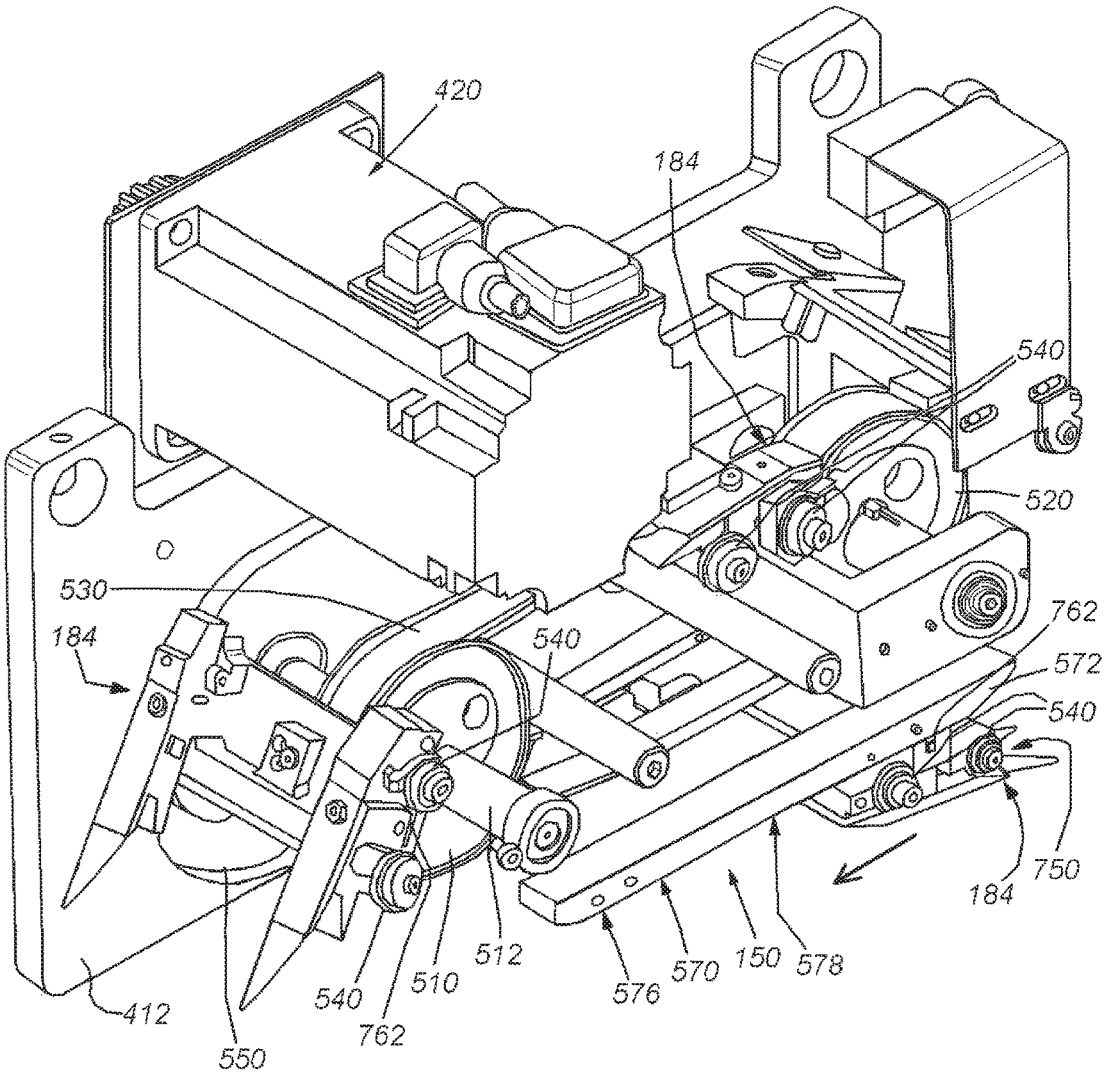
FIG. 5 is a partially exposed perspective view of the gripper assembly of FIG. 4 showing the gripper units mounted on a belt between sprockets and a ramp that actuates cam followers of respective gripper units.
Figure 6:
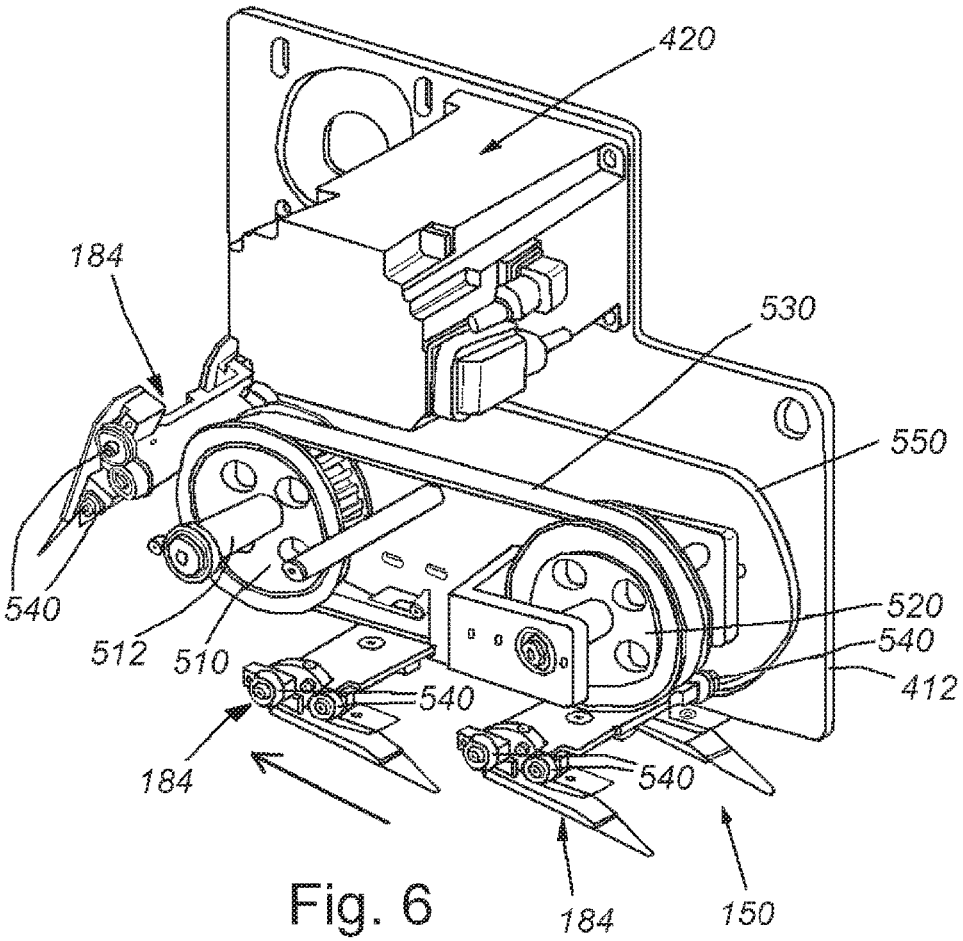
FIG. 6 is another partially exposed perspective view of the gripper assembly of FIG. 4.

With reference now to FIGS. 4-6, the gripper assembly 150, according to an illustrative embodiment, is shown in further detail. As described above, the gripper assembly can be adjustably mounted in the stacker. Likewise a plurality of gripper assemblies can be mounted side-by-side as appropriate. Each gripper assembly defines a discrete module with its own power source and interconnection to the stacker's controller 146.

As shown in FIG. 4, the gripper assembly 150 is enclosed within a pair of opposing side plates 410 and 412. This embodiment employs an onboard drive motor 420. The motor receives control and power from the controller 146 and drives a transmission (e.g. timing belt 424) to rotate a drive sprocket 424. This drive sprocket is interconnected to the main gripper drive shaft. In alternate embodiments, as described above, the drive motor can reside on a common shaft (e.g. splined shaft 230) and drive the gripper(s).

With further reference to FIGS. 5 and 6, the gripper assembly is shown exposed with the side plate 410 removed. As shown, the gripper assembly 150 consists of two sprockets 510 and 520. The upstream sprocket 510 resides on the gripper drive shaft 512, which is operatively connected to the drive motor 420. The sprockets 510 and 520 support a timing belt 530, upon which resides at least three gripper units 184. The number of gripper units 184 can vary based upon the size of the belt 530 and its speed of operation. In general, the sprocket and/or the timing belt can be modified to allow secure attachment of the gripper unit(s) 184 to the belt while providing clearance for the intermeshing timing belt teeth. In an embodiment, a tooth can be removed from the sprocket where it engages a fastener (holding the gripper unit to the belt) placed through the belt so that the fastener does not bind with the sprocket. Other arrangements, such as a belt tooth that doubles as a fastener nut or rivet base can be employed.

Notably, the gripper units 184 each include respective guide bearings 540 that ride in an ovular raceway groove 550 formed on the inside surface of each side plate 410 and 412. The geometry of the gripper units 184 is described further below. The shape of the grooves 550 ensure that each gripper unit maintains a fixed path as the timing belt 530 is rotated. The rotation of the timing belt 530 occurs according to a programmed acceleration and velocity profile, also described further below.

Figure 7:
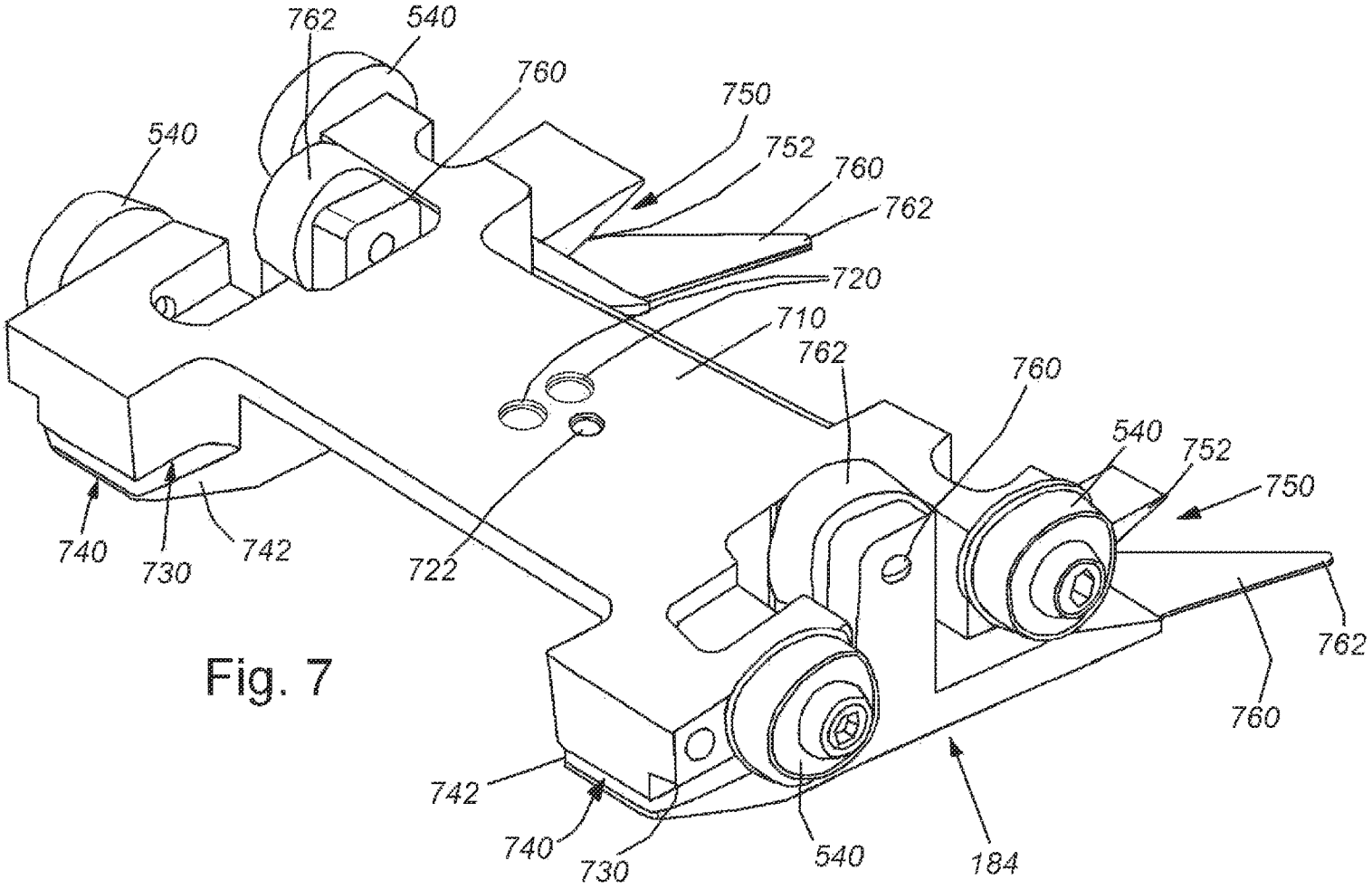
FIGS. 7-9 are each perspective views of a gripper unit of the gripper assembly of FIG. 4.
Figure 8:
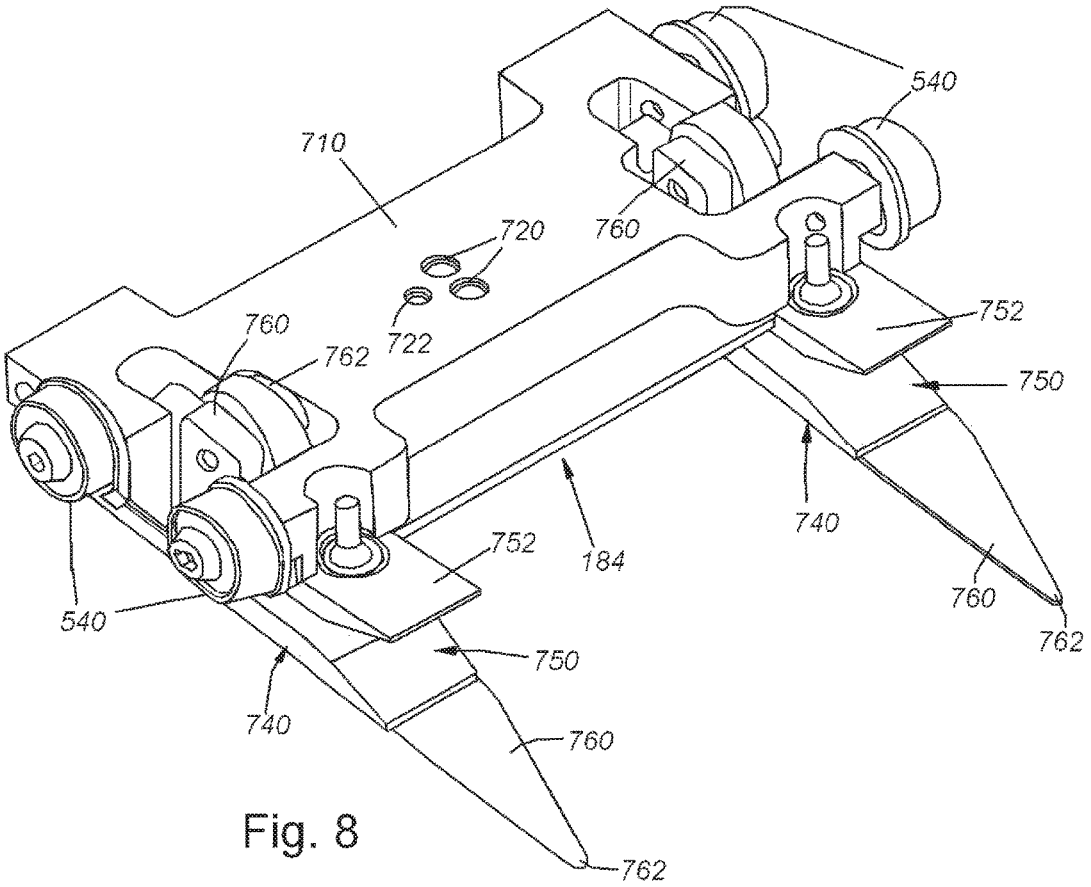
Figure 9:
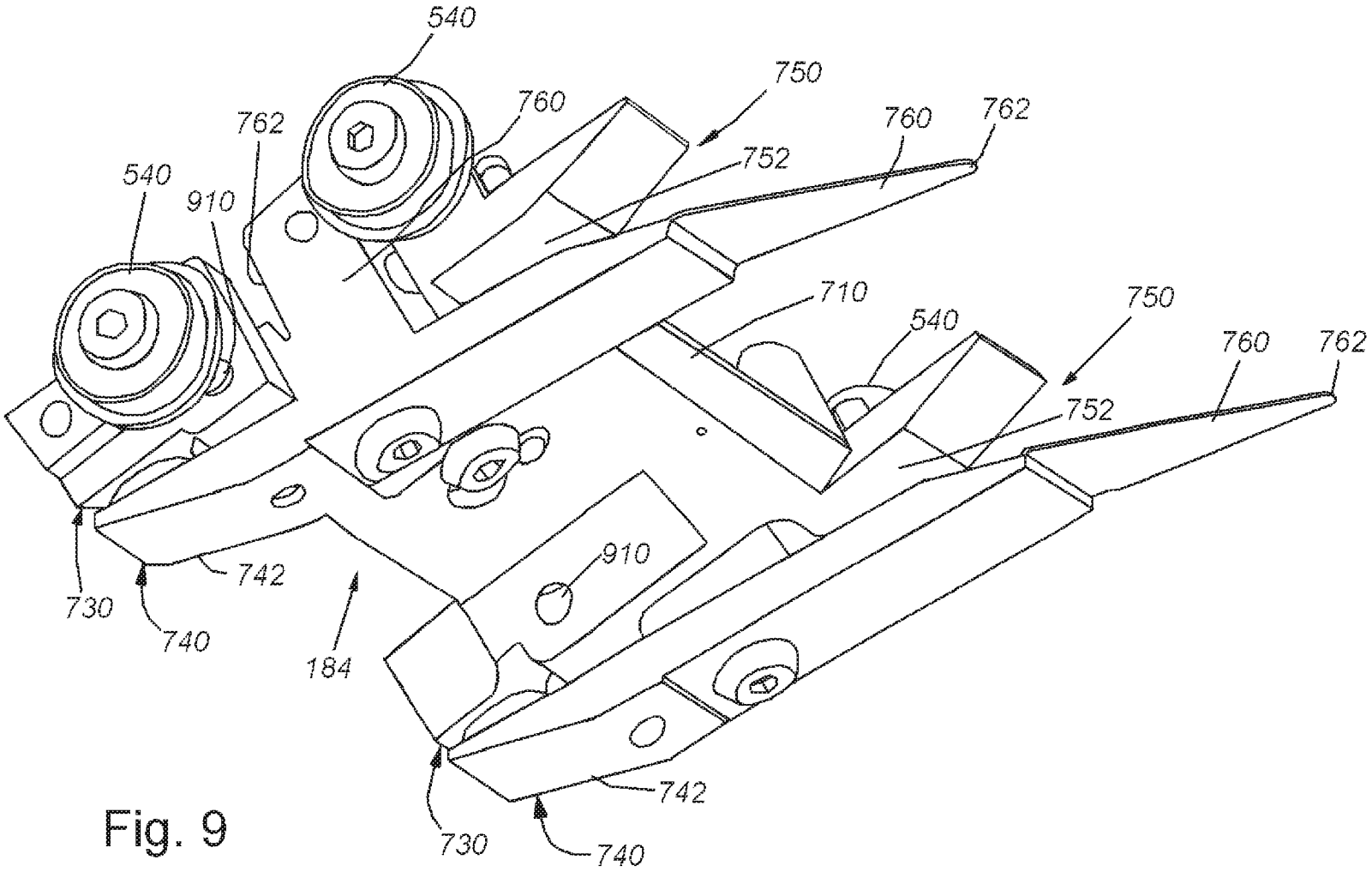

With reference also to FIGS. 7-9, the gripper units 184 are shown and described in further detail. The gripper unit 184 includes a base member 710 upon which the guide bearings 540 are mounted. The base includes mounting holes 720, 722 that receive fasteners interconnecting the base member 710 to the timing belt 530. The base member further defines a pair of platforms 730. The platforms 730 are positioned opposite extensions 742 of the movable jaw members 740. In this embodiment, the jaw members are separate units located on each opposing side of the base member 710. In an alternate embodiment, the jaw member can be a single piece spanning across the width of the base member. Each jaw member 740 rides on a pivot axle 910 (FIG. 9), mounted near the base member platform 730. The pivot axle 910 is positioned so that the jaws move toward and away from the base member to, respectively, grip and release a sheet. The jaw members 740 are each normally biased away from the respective platforms 730 by a compression spring (or similar biasing member) (not shown) located in opposing wells between the jaw member and the base member. A variety of alternate spring arrangements (e.g. a torsion spring, a tension spring, etc.) can be employed in a manner clear to those of skill. By biasing the platform 730 away from the jaw extension 742, the mouth 750 of each gripper pair (i.e. a jaw and an anvil portion 752 of the base member) is normally biased closed. The amount of pressure exerted by the gripping mouth is variable. Likewise, the surface of the jaw and/or platform can be smooth, textured or coated with an elastomer as appropriate to the sheet feeding requirements.

Each jaw member includes a lever arm that extends between the guide bearings 540. The distal end of the lever arm 760 (opposite the jaw member 740) carries a roller 762. With reference to FIG. 5, the roller is arranged to contact a ramp 570 having a surface shape that causes the lever arm 760 to move as the belt drives the gripper unit 184 along the length of the ramp. In this manner, the opening and closing of the gripper mouth 750 is actuated by the relative position of the roller 762 and lever arm with respect to the ramp. As depicted, the ramp 570 has a thicker (more downwardly extended) region near its front section 572—thereby causing the gripper to open and receive a driven sheet into the mouth 750. The mid section 578 of the ramp 570 is thinner (more upwardly extended), causing the mouth 750 to close, gripping the sheet. The rear section 576 of the ramp 570 is, again, thicker, causing the gripper mouth 750 to open and release the sheet as it contacts the backstop (190 in FIGS. 1-3). A ramp is secured to each side plate 410, 412 of the gripper assembly 150 so as to actuate each jaw 740 in the gripper unit 184.

Note that the mouth is constructed with a V-shaped cross section that assists in funneling the leading edge of each sheet into the confronting surfaces of the mouth 750. Additionally each jaw 740 includes a forwardly (in the upstream direction) and downwardly directed flexible extension finger 760. The extension finger 760 is pointed near its front end 762. It can be constructed from a durable, thin material, such as spring steel. Alternatively another type of lightweight material, such a polymer sheet (e.g. Mylar) can be used to form the finger. It serves to bias the sheets in the stack downwardly while providing a ramp that assists in directing the next input sheet upwardly into the gripper mouth 750. This geometry thereby avoids input sheets undercutting the existing stack and further assists in compressing the existing stack to remove air bubbles, etc. The extension member can extend 1-3 centimeters away from the jaw member 740 and can be directed 0.5-1 centimeter below the jaw member in an embodiment. The finger can include a tapered tip as shown, with a rounded over end to prevent digging into sheets. In various embodiments, the finger can define a permanently curved surface that reduces (but does not eliminate) pressure on the sheets in the stack.

Figure 10:
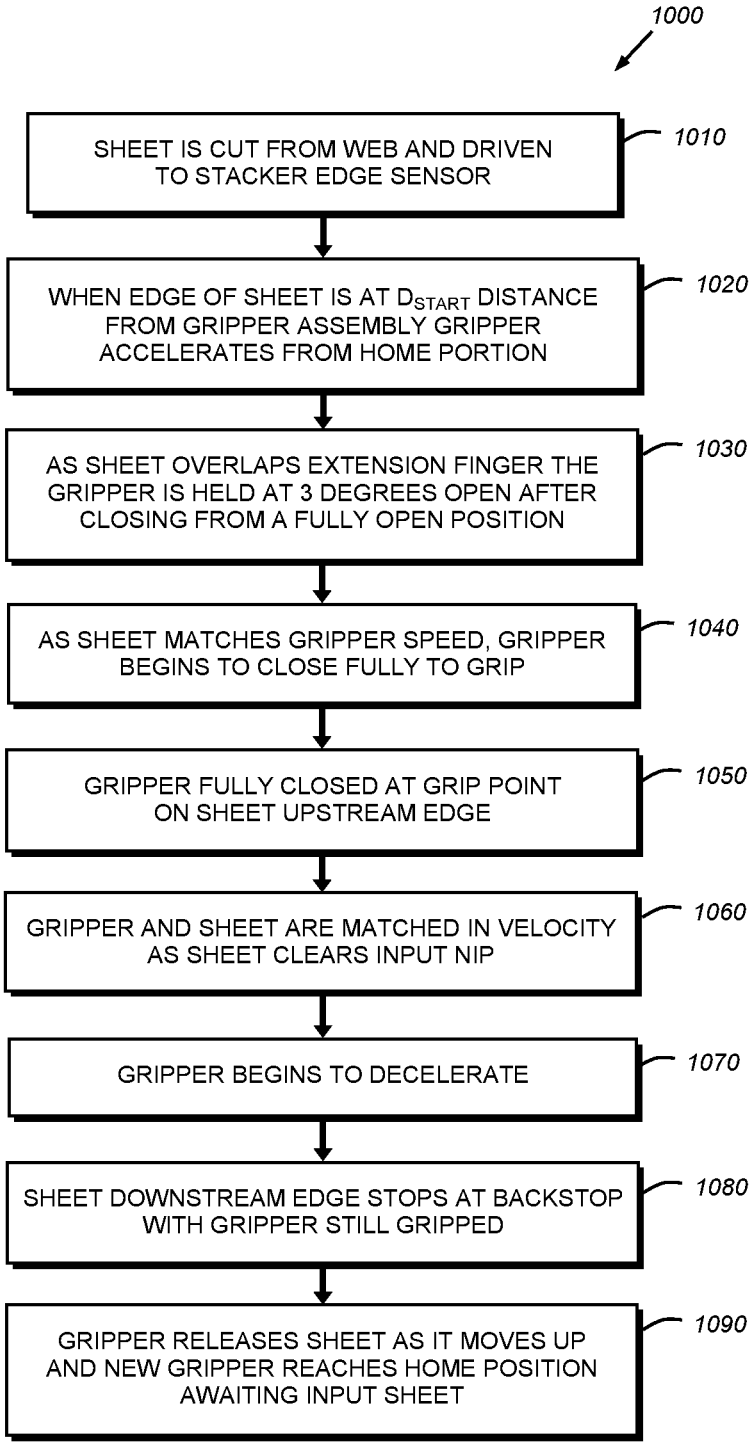
FIG. 10 is a flow diagram of a control and sheet motion process for the stacker of FIG. 1.
Figure 11:
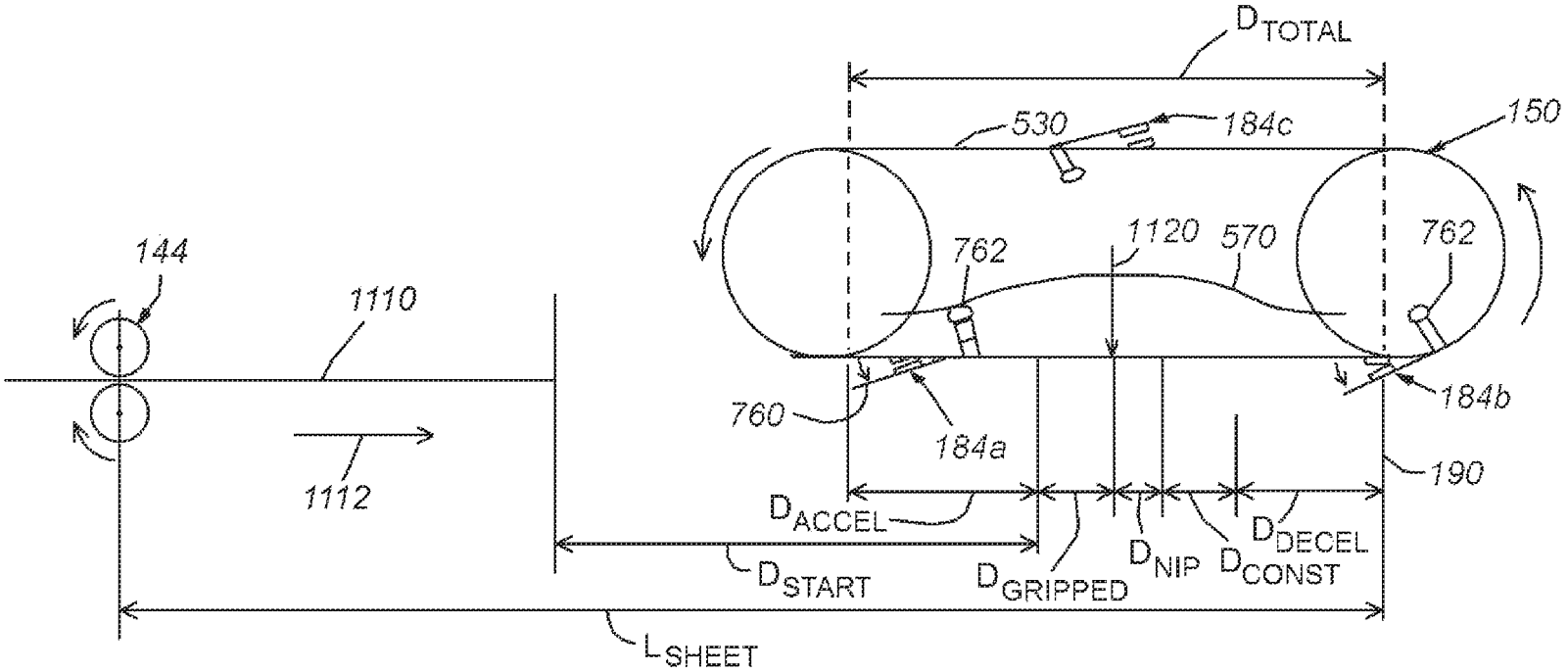
FIG. 11 is a schematic diagram of the arrangement of input drive and gripper assembly elements for an exemplary driven sheet shown as the gripper assembly is about to receive a sheet in accordance with the process of FIG. 10.
Figure 12:
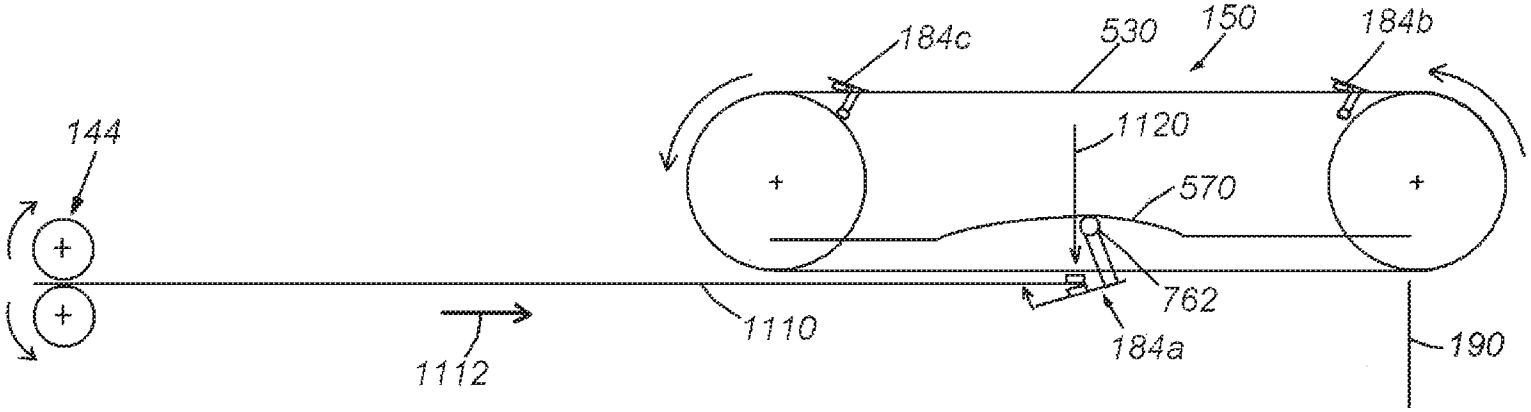
FIG. 12 is a schematic diagram of the arrangement of FIG. 11 with the driven sheet gripped at the grip point by the gripper assembly in accordance with the process of FIG. 10.
Figure 13:
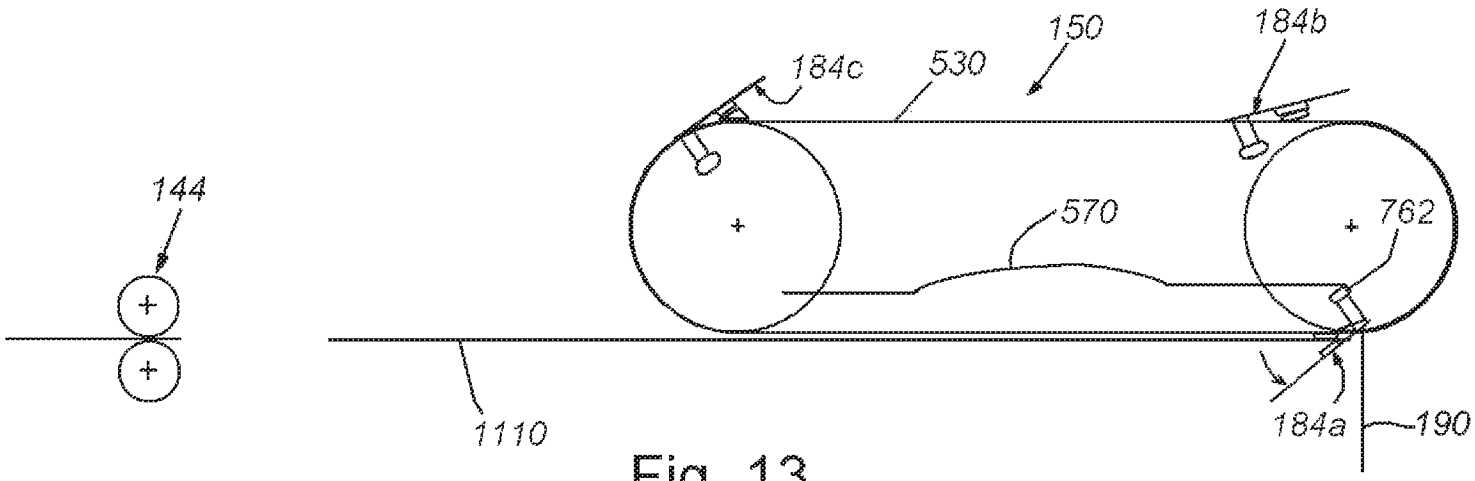
FIG. 13 is a schematic diagram of the arrangement of FIG. 11 with the driven sheet released by the gripper assembly adjacent to the backstop point in accordance with the process of FIG. 10.

Reference is now made to the procedure 1000 of FIG. 10 and schematic diagram of FIG. 11, showing the relative position of the input sheet 1110, input drive (nip rollers) 144, gripper assembly 150, and respective gripper units 184*a*, 184*b* and 184*c*. As shown, the gripper 184*a* is located in the "home" position, awaiting the input sheet 1110, which is driven (arrow 1112) by the rollers 144 after it has been cut by the cutter in procedure step 1010. Note that the gripper 184*a* is shown with lever arm roller 762 that acts as a cam follower riding along the ramp 570 to control the relative open/closed position of the gripper jaw. Per step 1020, when the edge of the sheet reaches a distance $D_{START}$, from the gripper 184*a*, the gripper assembly (and associated gripper 184*a*) accelerates over a distance $D_{ACCEL}$. This distance can be established based upon an encoder, tied to the cutter and drive and/or the above-described edge sensor 148. Then, as the input sheet 1110 (driven at a faster speed than the accelerating gripper 184*a*) catches up with the gripper, it overlaps the extension finger 760 and the gripper jaw closes from full open (8 degrees) to partially open (3 degrees) in step 1030. The gripper 184*a* moves over a distance $D_{GRIPPED}$ in this phase. In step 1040, the sheet 1010 matches the gripper speed and the gripper moves to close fully at the grip point 1120. This configuration is illustrated in FIG. 12. The gripper 184*a* is now fully closed in step 1050 while the sheet passes through the distance $D_{NIP}$ with the upstream edge of the sheet 1010 still grasped within the rollers 144. Then, in step 1060, the gripper 184*a* and rollers 144 travel at the same velocity, the upstream edge of the sheet exits the nip of the rollers 144 and is carried exclusively by the gripper 184*a* toward the backstop 190. This state continues over distance $D_{CONST}$. The gripper 184*a* then begins to decelerate in step 1070 as it approaches the backstop 190, over a distance $D_{DECEL}$. This condition is shown in FIG. 13. The gripper 184*a* begins to open to release the sheet 1010 as its downstream (leading) edge contacts the backstop 190 (step 1080). In step 1090, the gripper 184*a* moves away from the sheet 1010 and closes again (having disengaged from the ramp 570). A new gripper 184*c* moves into the home position awaiting input of the next sheet.

In an embodiment, the total operating distance $D_{TOTAL}$ for the gripper (184*a*) in a sheet feeding/staking operation as described above is approximately 80 millimeters. The exemplary parameters for other distances are as follows, and are approximate:

$D_{START}$=53.3 millimeters
$D_{ACCEL}$=26.7 millimeters
$D_{GRIPPED}$=2.8 millimeters
$D_{NIP}$=15.0 millimeters
$D_{CONST}$=0.0 millimeters
$D_{DECEL}$=35.6 millimeters These exemplary parameters should apply to a wide range of sheet lengths with appropriate upstream/downstream placement of the gripper assembly relative to the rollers 144. A sheet of 140 millimeters in length is provides as an example and is driven at approximately 3556 millimeters per second at maximum velocity.

In alternate arrangements, the number of gripper units on a belt 530 can be widely varied. Likewise, the operating distance of the gripper can be varied by altering the dimensions of the gripper assembly 150. More generally, the arrangement of drive rollers (144) can be varied and other forms of driving units (e.g. driving belts) can be provided in alternate embodiments.

It should be clear that the gripper assembly as described herein provides an effective mechanism for the high speed stacking of sheets that avoids misfeeds and damage to stack sheets. The assembly allows for flexible sheet handling in terms of length, width and number of side-by-side stacks. Additionally, the stacker effectively operates with sheets/substrates composed of (or including) materials that add challenges to the stacker and its operation. The stacking arrangement can effectively handle sensitive substrates, difficult media and applications with heavy or sensitive ink coverage. The stacker arrangement can also operate with media of various thicknesses and/or merged or stream folded substrates.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, as used herein the terms "process" and/or "processor" should be taken broadly to include a variety of electronic hardware and/or software based functions and components (and can alternatively be termed functional "modules" or "elements"). Moreover, a depicted process or processor can be combined with other processes and/or processors or divided into various sub-processes or processors. Such sub-processes and/or sub-processors can be variously combined according to embodiments herein. Likewise, it is expressly contemplated that any function, process and/or processor herein can be implemented using electronic hardware, software consisting of a non-transitory computer-readable medium of program instructions, or a combination of hardware and software. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). It is also contemplated that the sheet pathway can include additional sensors, such as presence sensors, jam sensors, etc. that are operatively connected with the controller in a manner clear to those of skill. Likewise, the operation of the stacker and associated gripper assembly can be coordinated with the operation of the cutter and other handling units via the controller and associated interconnections therebetween. Accordingly, this description is meant to be taken only by way of example, and not to otherwise limit the scope of this invention.

What is claimed is:

1. A system for stacking sheets comprising:

an input drive that receives sheets from a source and directs each of the sheets in a downstream direction at a selected input velocity;

a gripper assembly having a plurality of gripper units, each with a jaw member that moves between an open and a closed, gripped, position, the jaw member having an extension finger that extends outwardly and downwardly into pressurable engagement with a top sheet at a stacking location and that defines a ramp for the sheet directed from the input drive, the gripper units being mounted on a continuously moving surface that locates each of the gripper units over the stacking location, moving in the downstream direction; and a controller that operates the moving surface so that one of the gripper units moves to a closed position when a downstream edge of a respective one of the sheets is located at the jaw member and that moves to an open position when the downstream edge is adjacent to a backstop in the stacking location.

2. The system as set forth in claim 1 wherein the moving surface comprises a belt located between rotating sprockets.

3. The system as set forth in claim 2 wherein the belt includes at least three gripper units located at approximately even intervals along the belt, wherein at least one of the gripper units resides at a top side of the belt opposite a bottom side facing the stacking location.

4. The system as set forth in claim 2 wherein the gripper assembly includes side plates that enclose the belt and the sprockets.

5. The system as set forth in claim 4 wherein the side plates include a raceway in which a base member of each of the gripper units is guided and wherein the jaw member includes a cam follower that rides along a ramp when the jaw member is located over the stacking location.

6. The system as set forth in claim 5 wherein the gripper units each include a spring that normally biases the jaw member into a closed position and that is overcome by action of the cam follower in engagement with the ramp.

7. The system as set forth in claim 4 wherein the gripper assembly is mounted on a carriage and is operatively connected with a drive motor located on one of the side plates or a drive shaft interconnected with a motor on the carriage.

8. The system as set forth in claim 7 wherein the carriage is constructed and arranged to move upstream and downstream with respect to the stacking location based upon a length of each of the sheets.

9. The system as set forth in claim 8 wherein the carriage is constructed and arranged to support at least another side-by side gripper assembly having a plurality of gripper units, each with a jaw member that moves between an open and a closed, gripped, position, the gripper units being mounted on a continuously moving surface that locates each of the gripper units over a stacking location, moving in the downstream direction, the gripper assembly and the other gripper assembly each positioned to handle either wide sheets or a plurality of side-by-side streams of sheets.

10. The system as set forth in claim 9 wherein the stacking location defines an elevator that moves downwardly as a size of a stack of the sheets at the stacking location increases and that moves into position with a conveyor when the stack is completed.

11. The system as set forth in claim 1 wherein the extension finger comprises a thin, flexible material.

12. The system as set forth in claim 11 wherein the flexible material comprises spring steel.

13. The system as set forth in claim 1 further comprising an edge detector operatively connected to the controller that senses when each of the sheets from the input drive is a predetermined distance from the gripper assembly and thereby controls the gripper assembly.

14. The system as set forth in claim 1 where in each of the gripper units includes another jaw member that moves between an open and a closed, gripped, position.

15. A method for stacking sheets with the system of claim 1 comprising the steps of, accelerating the gripper assembly so that the one of the gripper units moves from a home position to match the input velocity, driving the sheet at approximately the input velocity while it is gripped with the jaw member in the closed position, decelerating the sheet as the one of the gripper units moves toward the backstop, and halting the one of the gripper units at the backstop as the jaw member is moved to an open position to release the respective one on the sheets on a stack at the stacking location.

16. The method as set forth in claim 15 further comprising the step of moving the one of the gripper units to a location remote from the stacking surface and positioning another of the gripper units in the home position engaging the stack.

17. The method as set forth in claim 16 wherein the step of accelerating includes detecting an edge of each of the sheets from the input drive and initiating acceleration in response thereto.

18. A system for stacking sheets comprising:

an input drive that receives sheets from a source and directs each of the sheets in a downstream direction at a selected input velocity;

a gripper assembly mounted on a carriage and having a plurality of gripper units, each with a jaw member that moves between an open and a closed, gripped, position, the gripper units being mounted on a continuously moving surface that locates each of the gripper units over a stacking location, moving in the downstream direction, the gripper assembly operatively connected with a drive motor located on the carriage; and a controller that operates the moving surface so that one of the gripper units moves to a closed position when a downstream edge of a respective one of the sheets is located at the jaw member and that moves to an open position when the downstream edge is adjacent to a backstop in the stacking location.

19. The system as set forth in claim 18, wherein the jaw member includes an extension finger that extends outwardly and downwardly into pressurable engagement with a top sheet at the stacking location and that defines a ramp for the sheets directed from the input drive.

20. The system of claim 18, wherein the carriage is constructed and arranged to support at least another side-by side gripper assembly having a plurality of gripper units, each with a jaw member that moves between an open and a closed, gripped, position, the gripper units being mounted on a continuously moving surface that locates each of the gripper units over a stacking location, moving in the downstream direction, the gripper assembly and the other gripper assembly each positioned to handle either wide sheets or a plurality of side-by-side streams of sheets.

* * * * *